United States Patent [19]

Brubaker

[11] 4,279,764

[45] Jul. 21, 1981

[54] ENCAPSULATED BLEACHES AND METHODS OF PREPARING THEM

[75] Inventor: Gaylen R. Brubaker, Lawrenceville, N.J.

[73] Assignee: FMC Corporation, Philadelphia, Pa.

[21] Appl. No.: 164,616

[22] Filed: Jun. 30, 1980

[51] Int. Cl.[3] ..... C11D 7/56

[52] U.S. Cl. ..... 252/99; 252/98; 252/187 H; 252/187 C; 427/212; 427/213; 427/214; 427/215; 427/220

[58] Field of Search ..... 282/99, 98, 187 H, 187 C; 427/212, 213, 214, 215, 220

[56] References Cited

U.S. PATENT DOCUMENTS

| | | | |
|---|---|---|---|
| 3,112,274 | 11/1963 | Morgenthalen et al. | 252/301.4 P |
| 3,528,921 | 9/1970 | Gray | 252/99 |
| 3,583,922 | 6/1971 | McLain et al. | 252/99 |
| 3,634,260 | 1/1972 | Dickin | 252/95 |
| 3,650,961 | 3/1972 | Hudson | 252/99 |
| 3,749,672 | 7/1973 | Golton et al. | 252/99 X |
| 3,816,320 | 6/1974 | Corliss | 252/99 |
| 3,817,869 | 6/1974 | Ries et al. | 252/99 |
| 3,821,117 | 6/1974 | Greece et al. | 252/99 |
| 3,908,045 | 9/1975 | Alterman et al. | 252/301.4 P |
| 3,925,239 | 12/1975 | Wanmaker et al. | 252/301.4 P |
| 3,936,388 | 2/1976 | Cheng | 252/99 |
| 3,944,497 | 3/1976 | Alterman et al. | 252/99 |
| 3,962,106 | 6/1976 | Rubin et al. | 252/95 X |
| 3,975,280 | 8/1976 | Hachmann et al. | 252/99 X |
| 3,983,254 | 9/1976 | Alterman et al. | 252/95 X |
| 4,078,099 | 3/1978 | Mazzola | 252/98 X |
| 4,123,376 | 10/1978 | Gray | 252/99 |
| 4,124,734 | 11/1978 | Alterman et al. | 252/99 |
| 4,126,717 | 4/1978 | Mazzola | 252/99 |
| 4,136,052 | 1/1979 | Mazzola et al. | 252/99 |
| 4,149,988 | 4/1979 | Brennan et al. | 252/99 X |

*Primary Examiner*—Mayer Weinblatt

*Attorney, Agent, or Firm*—Robert D. Jackson; Frank Ianno

[57] ABSTRACT

Bleaching compositions containing a chlorine bleaching agent coated with a silicate bound, hydrated, soluble salt containing an N—H chlorine accepting compound are described. Such compositions exhibit decreased localized dye attack of colored fabrics.

13 Claims, No Drawings

ENCAPSULATED BLEACHES AND METHODS OF PREPARING THEM

This invention relates to bleaching compositions, particularly to those having compatibility with detergents and which exhibit minimal dye and fabric damage.

It is well known that solid chlorine bleaches can result in fabric damage and excessive dye removal. These deleterious effects occur where the bleach is added to a dry load of laundry in a washing machine and remains next to the fabrics during the filling cycle. As the machine fills, pockets containing high concentrations and even pastes of the bleach are formed in the immediate vicinity of the fabrics. The resulting high levels of bleach at the fabric surface are extremely conducive to localized dye attack and very small spots will appear on the damaged textile surfaces in a characteristic pinpoint pattern.

It is also known that peroxygen bleaching agents can be used for bleaching colored fabrics without causing as much localized dye attack as do the more aggresive chlorine bleaching agents. Moreover, peroxygen bleaches are compatible with detergent components whereas detergent formulations containing chlorinating agents deteriorate during storage with concomitant decrease in both available chlorine and general cleansing effectiveness. Despite such drawbacks, chlorine type bleaching agents are still preferred because of their superior bleaching power.

There have been proposals for providing chlorine bleach compositions having improved storage stability and which cause less local dye attack during the laundering of colored fabrics. In general, such proposals involve coating or encapsulating the bleach particles, thereby retarding their rate of dissolution in the wash water. As a consequence, there is less localized buildup of high bleach levels next to the fabrics when these modified bleaches are added to a dry load of laundry in a washing machine. In addition, compositions containing encapsulated bleach particles have improved storage stability since the coated particles are protected against atmospheric moisture and from direct contact with other components in the compositions. Thus, commerical dry bleaches such as chlorinated isocyanurates, which normally decompose in the presence of detergent ingredients, can be incorporated into cleansing and sanitizing compositions by means of the coating technique aforesaid.

The encapsulation of reactive substances with a protective coating is well known and numerous coating materials and processes have been described. For instance, U.S. Pat. No. 3,112,274 discloses a dry granular bleach composition which is obtained by spraying an aqueous slurry of chlorinated isocyanurate onto a fluidized bed of a hydratable inorganic salt. The coated isocyanurate is said to be compatible with detergent formulations. U.S. Pat. Nos. 3,962,106 and 3,650,961 also pertain to granulated bleach compositions containing chloroisocyanurate particles coated with a soluble salt. Although such bleach compositions have improved storage stability, the salt coating does not retard dissolution of the bleach sufficiently so as to avoid dye attack from high local concentrations of bleach in contact with the fabric surfaces.

In U.S. Pat. Nos. 3,908,045, 3,944,497, 3,983,254, 4,136,052, 4,078,099, 4,124,734 and 4,126,717 there is described an encapsulation technique wherein reactive bleaching agents such as chlorocyanurates are coated with various types of waxes and polymers. The coating process consists in spraying a nonaqueous solution of the coating substance onto fluidized particles of the substance to be coated. Bleach compositions formulated with such coated bleaching agents are claimed to be non-pinholing. However, the need to use solvents in preparing the coated bleach is a serious disadvantage from a manufacturing standpoint. The coating procedure is rather complex and requires considerable outlay of equipment for controlling the process. For instance, the organic coating materials may react with the chlorine bleaching compound, particularly if exposed to heat. Moreover, it is difficult to produce the encapsulates aforesaid wherein the active component is released consistently at both hot and cold temperatures. In fact, multiple coatings are suggested for regulating dissolution over the range of laundry temperatures. Manifestly, this adds to the cost and complexity of manufacture. After dissolution of the encapsulated bleach particles, the coating material would remain in the wash water, possibly settling out on the fabric surfaces dulling colors and producing off-whites or otherwise interferring with the cleansing process.

Another approach for protecting dyes from attack by chlorine bleaches is to treat colored fabrics with an aqueous solution of hypohalite or a precursor thereof containing certain N—H compounds thereby forming an equilibrium mixture of the following composition wherein the N—H compound is sulfamic acid and the hypohalite is hypochlorite $$H_2NSO_3^- + OCl^- \rightarrow ClHNSO_3^- + OH^-$$

$$CLHNSO_3 + OCl^- \rightarrow Cl_2NSO_3^- + OH^-$$

According to U.S. Pat. No. 3,749,672, which describes such bleach solutions, the hypochlorite therein remains at a low level. However, as the free hypochlorite is depleted during use, more hypochlorite is generated owing to the tendency of the system to re-establish equilibrium. In U.S. Pat. No. 3,583,922, there are described detergent compositions containing a chlorine bleach and a soluble sulfamate. Whereas U.S. Pat. No. 3,749,672 asserts that the combination of a hypochlorite bleach and sulfamic acid is a slower, less vigorous bleaching system that hypochlorite alone, U.S. Pat. No. 3,583,922 on the other hand, teaches that under alkaline conditions which occur in the use of an alkaline detergent cleaner, the sulfamic improves the speed of bleaching.

Thus far, a satisfactory storage stable chlorine dry bleach compatible with detergent components and which does not cause dye removal during the laundering of colored fabrics has not been realized.

In accordance with the present invention there is provided an improved storage stable, halogen bleach system comprising encapsulated particles of a halogen bleaching agent having at least one reactive N-halo atom which releases hypohalite ion under aqueous bleaching conditions, the said particles having thereon a coating of a soluble, hydrated, silicate bound inorganic salt in admixture with an N—H compound, which N—H compound reacts relatively rapidly with the hypohalite ion to produce the corresponding N-halo compound under conditions of elevated hypohalite levels surrounding the encapsulated bleach particles undergoing initial dissolution in aqueous media during preparation of the bleach solution, but which N—H compound reacts relatively slowly with the hypohalite to form said corresponding N-halo compound under the conditions of low hypohalite levels in the final bleach solution after mixing and dissolution of the bleaching agent.

Generally, the invention herein as carried out by preparing a particulate mixture of an organic N-halogen bleaching agent, a soluble, inorganic hydratable salt and an N—H compound of the type that reacts with hypohalite in aqueous media to form the corresponding N—Cl compound and contacting the mixture with an aqueous solution of an alkali metal silicate whereby the inorganic salt undergoes hydration and envelopes the bleach particles in a coating of silicate bound, hydrated salt containing the N—H compound. When such coated bleach particles are added to wash water, the coating dissolves first, momentarily enveloping the bleach particles in a concentrated N—H compound. This envelope of concentrated N—H compound then reacts with the dissolving bleach particles thereby moderating bleaching action in the region of high bleach density. Colored fabrics exposed to the local bleach action aforesaid are thus protected against dye attack until washer agitation is commenced and the bleach reaches normal strength, typically 10 to 200 ppm active chlorine. Simple physical blends of the bleach components as exemplified by the sulfamate containing chlorine bleaches of previously cited U.S. Pat. No. 3,585,922 does not provide such protective action.

It is thought that the N—H compound is substantially converted into the corresponding N-halo compound in the high soluble region around the dissolving bleach particle thereby suppressing high levels of free hypohalite from building up. Once the N-halo compound is mixed with the bulk of the washing medium, hydrolysis of the N-halo occurs and normal levels of hypohalite are established. Such explanation is offered merely as a theory and other possible reaction mechanisms may be occuring.

The encapsulated halogen bleach product herein is prepared in the known manner of applying a silicate bound, hydrated salt coating to particulate halogen bleaching agents. Generally, such a procedure, commonly referred to as agglomeration involves contacting a finely divided, soluble anhydrous inorganic salt with aqueous alkali metal silicate in the presence of the halogen bleach particles while maintaining some form of agitation. On contact with the aqueous silicate, the anhydrous salt undergoes hydration to give hydrated salt particles which are bound together by the silicate into agglomerates containing embedded bleach particles.

Agglomeration of the solids aforesaid may be accomplished by spraying them with a mist of the silicate solution. The contacting may also be effected by pouring or dripping the liquid onto the solids. Whichever way the contacting is carried out, the solids should be constantly in motion e.g. on a moving bed so there is intimate contact between the solid particles and the agglomerating silicate solution. Moving beds which have been found satisfactory include such well known devices as paddle and blade-type mixers, rotating drums and inclined discs. The agglomerated product is then dried at about 20° to 50° C. after which it can be packaged as such or added to a detergent formulation.

A key feature of the invention is controlling the particle size of the various solids. Desirably at least 50% by weight of the non-bleach solids have a mean diameter of about 2–30 times smaller than the mean diameter of the halogen bleach. In this way, a large number of small contiguous encapsulating particles bound together with the silicate form a coating around the larger bleach particles. The ratio of N-halo compound to N—H compound in the encapsulated bleach product is from about 1:1 to about 50:1, preferably about 2:1 to about 10:1.

The N-halo compound is desirably an N-chloro compound although N-bromo and N-iodo compounds may be preferred where optimum germicidal activity is a factor. Normally, the N-chloro compounds will be an oxidant of the type which releases chlorine under detergent bleaching conditions, such as potassium dichloroisocyanurate, sodium dichloroisocyanurate and hydrates thereof, monochloramine, dichloroamine, [(mono-trichloro-)tetra-(mono-potassium dichloro)]-penta-isocyanurate, 1,3-dichloro-5,5-dimethyl hydantoin, para-toluenesulfonyldichloroamide, trichloromelamine, N-chloromelamine, N-chlorosuccinimide, N,N'-dichloroazodicarbonamide, N-chloroacetyl urea, N,N'-dichlorobiuret, chlorinated dicyandiamide, trichlorocyanuric acid and dichloroglycoluril.

Suitable hydratable inorganic salts are sodium carbonate, trisodium phosphate, disodium phosphate, sodium sulfate and condensed polyphosphates such as $Na_4P_2O_7$ and $Na_5P_3O_{10}$; partial hydrates of these salts can also be used.

The alkali metal silicate encapsulating liquid is conveniently a sodium silicate solution having a $SiO_2/Na_2O$ ratio of from about 3.22:1 to about 2.40:1 and a total solids content of about 1.0–50%. Preferred solutions have 20–35% solids with $SiO_2/Na_2O$ ratio of from about 2.84:1 to 3.22:1. The encapsulated bleach product here may include inert ingredients such as sodium alumina silicates, sodium sesquicarbonate, sodium bicarbonate, sodium chloride, silica flour and salts of organic acids.

The present invention provides a new bleach system and is based on the discovery that incorporation of an N—H compound in the silicate bound hydrated salt coating of encapsulated halogen bleach particles decreases dye damage in the region of high bleach concentration such as occurs when the bleach is first added to a dry laundry load. The effect was first encountered using a soluble sulfamate as the N—H compound. So far as can be ascertained, the sulfamate substantially ties up the active chlorine presumably as N—Cl in the concentrated bleach region surrounding the initially dissolving bleach particles but releases active chlorine when the bleach approaches full dilution on mixing with the bulk of the wash solution. It will be appreciated that other halogen accepting N—H compounds can be substituted for the sulfamate in formulating the chlorine bleach system of the invention. Other types of such N—H compounds which have been found to function similarly to sulfamates are N-alkylcarboxamides such as caprolactam and certain aminoacids such as alanine. Such compounds should, of course, be soluble and stable under bleaching conditions.

Generally, the composition of the encapsulated chlorine bleach of the invention is as follows:

| Components | Percentage by Weight |
|---|---|
| Chlorinated Cyanurate | 1–40 preferably 20–30 |
| Soluble, Anhydrous Inorganic Salt | 30–90 preferably 40–70 |
| Sodium Silicate | 2–20 preferably 5–15 |

-continued

| Components | Percentage by Weight |
|---|---|
| N—H Compound | 1–20 preferably 5–15 |

When utilizing the encapsulated particles of the herein invention in a detergent formulation, the available chlorine level in the wash water is about 10 to about 200 parts per million (ppm). The preferred range is about 15 to about 150 ppm as this concentration is the most effective use level of the chlorine bleaching agent. Such levels determine the amount of encapsulated particles which are incorporated into the detergent formulation.

Although the encapsulated bleaches prepared in accordance with the invention can be added to the wash solution, they are conveniently introduced as a component of the detergent or soap formulation.

Organic detergents suitable for use in accordance with the present invention encompass a relatively wide range of materials and may be of the anionic, non-ionic, cationic or amphoteric types.

The anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or rosin acids, such as may be derived from fats, oils, and waxes of animal, vegetable or marine origin, e.g., the sodium soaps of tallow, grease, coconut oil, tall oil and mixtures thereof; and the sulfated and sulfonated synthetic detergents, particularly those having about 8 to 26, and preferably about 12 to 22, carbon atoms to the molecule.

As examples of suitable synthetic anionic detergents the higher alkyl mononuclear aromatic sulfonates are preferred, particularly the LAS type such as the higher alkyl benzene sulfonates containing from 10 to 16 carbon atoms in the alkyl group, e.g., the sodium salts such as decyl, undecyl, dodecyl (lauryl), tridecyl, tetradecyl, pentadecyl, or hexadecyl benzene sulfonate and the higher alkyl toluene, xylene and phenol sulfonates; alkyl naphthalene sulfonate, ammonium diamyl naphthalene sulfonate, and sodium dionyl naphthalane sulfonate.

Other anionic detergents are the olefin sulfonates, including long chain alkene sulfonates, long chain hydroxyalkane sulfonates or mixtures of alkenesulfonates and hydroxyalkanesulfonates. These olefin sulfonate detergents may be prepaed, in known manner, by the reaction of $SO_3$ with long chain olefins (of 8–25 preferably 12–21 carbon atoms) of the formula RCH—$CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such the reaction products of alpha olefins and bisulfites (e.g. sodium bisulfite), e.g. primary paraffin sulfonates of about 10–20 preferably about 15–20 carbon atoms; sulfates of higher alcohols; salts of α-sulfofatty esters (e.g. of about 10 to 20 carbon atoms, such as methyl α-sulfomyristate or α-sulfotallowate).

Examples of sulfates of higher alcohols are sodium lauryl sulfate, sodium tallow alcohol sulfate; Turkey Red Oil or other sulfated oils, or sulfates or mono- or diglycerides of fatty acids (e.g. stearic monoglyceride monosulfate), alkyl poly(ethenoxy) ether sulfates such as the sulfates or the condensation products of ethylene oxide and lauryl alcohol (usually having 1 to 5 ethenoxy groups per molecule); lauryl or other higher alkylglyceryl ether sulfonates; aromatic poly(ethenoxy)ether sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g. sodium lauroylsarcosinate), the acyl ester (e.g., oleic acid ester) of isoethionates, and the acyl N-methyl taurides (e.g. potassium N-methyl lauroyl or oleyl tauride).

Other highly preferred water soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols with ethylene oxide, for example, the reaction product of octyl phenol with about 6 to 30 ethylene oxide units; condensation product of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitol monolaurate, sorbitol mono-oleate and mannitol monopalmitate, and the condensation products of polypropylene glycol with ethylene oxide.

Cationic surface active agents may also be employed. Such agents are those surface active detergent compounds which contain an organic hydrophobic group and a cationic solubilizing group. Typical cationic solubilizing groups are amine and quaternary groups.

As examples of nonionic surface active agents which may be used there may be noted the condensation products of alkyl phenols with ethylene oxide, e.g., the reaction product of octyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitol monolaurate, sorbitol monooleate and mannitol monopalmitate, and the condensation products of polypropylene glycol with ethylene oxide.

Cationic surface active agents may also be employed. Such agents are those surface active detergent compounds which contain an organic hydrophobic group and a cationic solubilizing group. Typical cationic solubilizing groups are amine and quaternary groups.

As examples of suitable synthetic cationic detergents there may be noted the diamines such as those of the type $RNHC_2H_4NH_2$ wherein R is an alkyl group of about 12 to 22 carbon atoms, such as N-2-aminoethyl stearyl amine and N-2-aminoethyl myristyl amine; amide-linked amines such as those of the type $R^1CONHC_2H_4NH_2$ wherein R is an alkyl group of about 9 to 20 carbon atoms, such as N-2-amino ethyl stearyl amide and N-amino ethyl myristyl amide; quaternary ammonium compounds wherein typically one of the groups linked to the nitrogen atom are alkyl groups which contain 1 to 3 carbon atoms, including such 1 to 3 carbon alkyl groups bearing inert substituents, such as phenol groups, and there is present an anion such as halide, acetate, methosulfate, and the like. Typical quaternary ammonium detergents are ethyldimethyl-stearyl ammonium chloride, benzyldimethylstearyl ammonium chloride, benzyl-diethyl-stearyl ammonium chloride, trimethyl stearyl ammonium chloride, trimethyl-cetyl ammonium bromide, dimethylethyl dilauryl ammonium chloride, dimethyl-propyl-myristyl ammonium chloride, and the corresponding methosulfates and acetates.

Examples of suitable amphoteric detergents are those containing both an anionic and a cationic group and a hydrophobic organic group, which is advantageously a higher aliphatic radical, for example, of 10–20 carbon atoms. Among these are the N-long chain alkyl aminocarboxylic acids for example of the formula

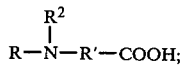

the N-long chain alkyl iminodicarboxylic acids (e.g. of the formula $RN(R'COOH)_2$) and the N-long chain alkyl betaines e.g. of the formula

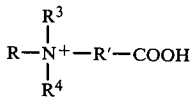

where R is a long chain alkyl group, for example of about 10–20 carbons, R′ is a divalent radical joining the amino and carboxyl portions of an amino acid (for example, an alkylene radical of 1–4 carbon atoms), H is hydrogen or a salt-forming metal, $R^2$ is a hydrogen or another monovalent substituent (for example, methyl or other lower alkyl), and $R^3$ and $R^4$ are monovalent substituents joined to the nitrogen by carbon-to-nitrogen bonds (for example, methyl or other lower alkyl substituents). Examples of specific amphoteric detergents are N-alkyl-beta-aminopropionic acid; N-alkyl-beta-iminodipropionic acid, and N-alkyl, N,N-dimethy glycine; the alkyl group may be, for example, that derived from coco fatty alcohol, lauryl alcohol, myristyl alcohol (or a lauryl-myristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (for example of 10 to 20 atoms) with diethylene triamine and monohalocarboxylic acids having 2 to 6 carbon atoms, for example, 1-coco-5-hydroxyethyl-5-carboxymethylimidazoline; betaines containing a sulfonic group instead of the carboxylic group; betaines in which the long chain substituent is joined to the carboxylic group without an intervening nitrogen atom, for example, inner salts of 2-trimethylamino fatty acids such as 2-trimethylaminolauric acid, and compounds of any of the previously mentioned types but in which the nitrogen atom is replaced by phosphorus.

The instant compositions optionally contain a detergency builder of the type commonly added to detergent formulations. Useful builders herein include any of the conventional inorganic and organic water-soluble builder salts. Inorganic detergency builders useful herein include, for example, water-soluble salts of phosphates, pyrophosphates, orthophosphates, polyphosphates, silicates, carbonates, zeolites, including natural and synthetic and the like. Organic builders include various water-soluble phosphonates, polyphosphonates, polyhydroxysulfonates, polyacetates, carboxylates, polycarboxylates, succinates, and the like.

Specific examples of inorganic phosphate builders include sodium and potassium tripolyphosphates, phosphates, and hexametaphosphates. The organic polyphosphonates specifically include, for example, the sodium and potassium salts of ethane 1-hydroxy-1,1-diphosphonic acid and the sodium and potassium salts of ethane1,1,2-triphosphonic acid. Examples of these and other phosphorus builder compounds are disclosed in U.S. Pat. Nos. 3,159,581, 3,213,030, 3,422,021, 3,422,137, 3,400,176 and 3,400,148. Sodium tripolyphosphate is an especially preferred, water-soluble inorganic builder herein.

Non-phosphorus containing sequestrants can also be selected for use herein as detergency builders.

Specific examples of non-phosphorus, inorganic builder ingredients include water-soluble inorganic carbonate, bicarbonate, water insoluble crystalline and amorphous aluminosilicates and silicate salts. The alkali metal, for example, sodium and potassium, carbonates , bicarbonates, and silicates are particularly useful herein.

Other water-soluble, organic builders are also useful herein. For use, the alkai metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylenediaminetetraacetic acid, nitrilotriacetic acid, oxydisuccinic acid, mellitic acid, benzene polycarboxylic (that is, penta- and tetra-) acids, carboxymethylsuccinic acid and citric acid.

Highly preferred non-phosphorus builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other preferred organic builders herein are the polycarboxylate builders set forth in U.S. Pat. No. 3,308,067, incorporated herein by reference. Examples of such materials include the water-soluble salts of homo- and copolymers of aliphatic carboxylic acids such as maleic acid, itaconic acid, mesaconic acid, fumaric acid, aconitic acid, citraconic acid and methylenemalonic acid.

The builders aforesaid, particularly the inorganic types, can function as buffers to provide the requisite alkalinity for the bleaching solution. Where the builder does not exhibit such buffer activity, an alkaline reacting salt can be incorporated in the formulation. The composition will contain a buffering agent in sufficient quantity to maintain a pH of about 8.5 to 10.0 when the composition is dissolved in water. The buffering agent can constitute from about 1% to about 95% (wt.) of the dry blended composition.

The herein bleach compositions can be provided for use in combination with a detergent agent or as a fully-formulated built detergent. Such compositions will comprise from about 5 to about 50% of the herein bleach system, from about 5 to 50% (wt.) of the detergent agent and optionally from about 1 to 60% (wt.) of a detergency builder which can also function as a buffer to provide the requisite pH range when the composition is added to water.

The compositions herein can include detergent adjunct materials and carriers commonly found in laundering and cleaning compositions. For example, various perfumes, optical brighteners, fillers, anti-caking agents, fabric softeners, and the like can be present to provide the usual benefits occasioned by the use of such materials in detergent compositions. Enzymes, especially the thermally stable proteolytic and lipolytic enzymes used in laundry detergents, also can be dry-mixed in the compositions herein.

Test Procedures

A. Localized Dye Attack

Localized dye attack was tested by placing a 3 gram sample of a chlorine containing detergent (generally 1.12% available chlorine) between 2 prewashed swatches of 100% cottom denim (6"×6") in a one liter beaker. A 500–600 ml/portion of water was then added to the beaker and the beaker allowed to stand for 90 seconds at 35°–40° C. A numerical rating system was designed to record the extent (area) and intensity (color change) of the bottom swatch. To record the area affected, a transparent grid of 3/16" squares was placed over the swatch and a number of squares with visible attack counted. Over 70 yielded a one rating, 50–69 a two, 30–49 a three, 10–29 a four and less than 10 a five. Intensity measurements were more subjective, but again a five rating was given to the most desirable (no visual change) and lower ratings to more intense dye attack. Data is reported as the average of the intensity and extent rating.

The detergent formulation had the following composition:

Sodium tripolyphosphate: 22%
Surfactants: 17%
Sodium Sulfate: 38%
Sodium Carbonate: 2%
Silicate Solids: 10%
CMC: 1%
Moisture: 10%

B. Tea Stain Removal

Terg-O-Tometer tests are performed using detergent solutions prepared from A supra containing 1.5 g/l of a detergent powder and 17 ppm available chlorine from several different dry chlorine bleach sources. These formulations were compared to each other and to a control formulation of 1.5 g of the detergent powder. The temperature is 40° C. (105° F.) using well water (150 ppm hardness) and a washing time of 15 minutes. The tests are performed on cotton and cotton polyester blend 10×12.5 cm. (4"×5") swatches that had been stained with Lipton tea and heat set in a clothes dryer for 45 minutes prior to rinsing. Stain removal is reported as the change in the whiteness index (ΔWI) of the swatches. This is found by taking the L, a, and b readings from a Hunter D25 Reflectometer before and after washing, and applying them to the following equations:

$$WI = L + 3\,(a - b)$$

$$\Delta WI = WI_{after} - WI_{before}$$

C. Storage Stability

Accelerated storage stability tests were performed by blending sufficient chlorocyanurate or encapsulated cyanurate with a detergent formulation to deliver 1.1% available chlorine. These formulations were then stored in sealed 4 oz. jars at 50° C. or in jars with semipermeable closures at 38° C. with 80% relative humidity. Samples were withdrawn after 3 weeks and analyzed for available chlorine.

The detergent formulation had the following composition:

Sodium Tripolyphosphate: 26%
Surfactants: 20%
Sodium Sulfate: 18%
Sodium Carbonate: 9%
Silicate Solids: 2%
CMC 1%
Moisture: 7%
Zeolite A: 18%

Reference is now made to the following non-limiting examples.

EXAMPLE 1

Preparation of Encapsulated Bleach

A dry mix was prepared having the following composition.

Sodium carbonate (anhydrous)
Sodium dichloroisocyanurate dihydrate
N—H compound

The anhydrous sodium carbonate was milled before use such that about 70% of the particles are between 100 and 200 mμ. The particle size of the chlorine acceptor (N—H compound) is essentially identical to that of the sodium carbonate. The particle size of the bleach consists of about 70% between 200 and 600 mμ. Standard milling or grinding devices such as a Thomas mill are used to pulverize the solids followed by sieving to give the desired particle size range.

In preparing the dry mix, the sized components are intimately mingled until a homogeneous granular product is obtained. This was effected in a Kelly Patterson twin shell blender, a machine commonly employed in the blending of powdered solids.

The dry mix aforesaid is then agglomerated with aqueous alkali metal silicate by charging into a mixing zone. Any suitable mixing device such as an inclined pan or disk agglomerator, a rotating drum or any other vessel with suitable means of agitation is satisfactory. Methods of agitating such particulate blends with aqueous alkali metal silicate to produce agglomerated products are well known to those skilled in the art.

Examples 1 to 5 of the invention were prepared by carrying out the agglomeration in a Model N-50 Hobart Mixer. A hand pump sprayer was charged with a sodium silicate solution which was sprayed onto the stirred solids over a 30 minute period. Stirring was continued an additional 20 minutes and the mixture dried for 30 minutes at 40° C. in an Aeromatic fluid bed drier. Comparison examples 1a to 3a were also prepared without the sulfamate N—H compound of the invention. The composition of examples 1-5 and comparison examples 1a-3a together with dye attack and storage stability data are set forth in Table I. Tea stain removal data is given in Table II.

Referring to Table I, it will be observed that the encapsulated chlorine bleach of the invention containing an N—H compound, e.g., sulfamic acid causes less injury to dyed fabrics than comparable formulations without the sulfamate. Moreover, the presence of the N—H compound does not adversely affect storage stability of the encapsulated bleach as shown by the storage stability test data. The non-agglomerated detergent bleach composition of example 6 having an active chlorine level identical to the previous examples of Table I gives a dye attack rating of 1 clearly demonstrating that simple physical blends of sulfamic acid and a halogen bleaching agent such as those of previously cited U.S. Pat. No. 3,583,922 provide virtually no protection against localized dye attack.

Referring to Table II, it can be seen that the bleaching action of the compositions of the invention are generally equal to comparable compositions without the N—H compound. Thus, the presence of the N—H compound, while inhibiting dye attack, does not deleteriously affect bleaching action.

TABLE I

| Example | Dry Mix | | Weight in Grams and Content of the Agglomerating Silicate Liquid $SiO_2/Na_2O$ | Grams | % Wt. Solids | Dye Attack | Storage Stability 38° C./80% R.H. | 50° C. |
|---|---|---|---|---|---|---|---|---|
| 1 | NaDCC . $2H_2O$ | 70 g | 2.84 | 113 | 36 | 4.0 | 54 | 61 |
| | $Na_2CO_3$ | 300 g | | | | | | |
| | Sulfamic Acid | 35 g | | | | | | |
| 1a | NaDCC . $2H_2O$ | 70 g | 2.84 | 112 | 36 | 3.0 | 61 | 60 |
| | $Na_2CO_3$ | 300 g | | | | | | |
| 2 | NaDCC . $2H_2O$ | 70 g | 2.84 | 102 | 36 | 4.0 | 76 | 73 |
| | $Na_2CO_3$ | 300 g | | | | | | |
| | Sulfamic Acid | 35 g | | | | | | |
| 2a | KDCC | 70 g | 2.84 | 103 | 36 | 3.5 | 93 | 56 |
| | $Na_2CO_3$ | 300 g | | | | | | |
| 3 | NaDCC | 70 g | 2.84 | 151 | 36 | 4.5 | 69 | 70 |
| | $Na_2CO_3$ | 300 g | | | | | | |
| | Sulfamic Acid | 35 g | | | | | | |
| 3a | NaDCC | 70 g | 2.84 | 101 | 36 | 2.0 | 69 | 69 |
| | $Na_2CO_3$ | 300 g | | | | | | |
| 4 | $Na_2CO_3$ | 55 g | 3.22 | 27 | 30 | 4.5 | | |
| | NaDCC . $2H_2O$ | 13 g | | | | | | |
| | Caprolactam | 5 g | | | | | | |
| 5 | $Na_2CO_3$ | 55 g | 3.22 | 27 | 30 | 4.0 | | |
| | NaDCC . $2H_2O$ | 13 g | | | | | | |
| | Alanine | 5 g | | | | | | |
| 6 | Detergent | 3 g | | | | 1.0 | | |
| | NaDCC . $2H_2O$ | 0.060 g | | | | | | |
| | Sulfamic Acid | 0.030 g | | | | | | |

KDCC = Potassium dichloroisocyanurate
NaDCC = Sodium dichloroisocyanurate

TABLE II

Enhanced Tea Stain Removal
With Detergents Containing Chlorocyanurates
Encapsulated in a Silicate Bound, Hydratable Inorganic Salt
(Procedure B)

| Example | Chlorocyanurate | N—H Compound | Enhanced Bleaching Cotton | Blend | Average |
|---|---|---|---|---|---|
| 1 | NaDCC . $2H_2O$ | Sulfamic Acid | 5.6 | 2.0 | 3.8 |
| 1a | NaDCC . $2H_2O$ | None | 1.1 | 3.9 | 2.5 |
| 2 | KDCC | Sulfamic Acid | 8.8 | 1.6 | 5.2 |
| 2a | KDCC | None | 6.2 | 0.4 | 3.3 |

TABLE II-continued

Enhanced Tea Stain Removal
With Detergents Containing Chlorocyanurates
Encapsulated in a Silicate Bound, Hydratable Inorganic Salt
(Procedure B)

| Example | Chlorocyanurate | N—H Compound | Enhanced Bleaching Cotton | Blend | Average |
|---|---|---|---|---|---|
| 3 | NaDCC | Sulfamic Acid | 8.7 | 2.3 | 5.5 |
| 3a | NaDCC | None | 16.7 | 9.6 | 13.2 |
| 4 | NaDCC . $2H_2O$ | Caprolactam | 12.8 | 5.0 | 8.9 |
| 5 | NaDCC . $2H_2O$ | Alanine | 14.6 | 5.6 | 11.1 |

NaDCC = Sodium dichloroisocyanurate
KDCC = Potassium dichloroisocyanurate
Enhanced Tea Stain Removal is defined as the improvement in stain removal compared to detergent alone.

What is claimed is:

1. A storage stable, halogen bleach system having improved fabric dye compatibility comprising encapsulated particles of a halogen bleaching agent having a least one reactive N-halo atom which releases hypohalite ion under aqueous bleaching conditions, the said particles having thereon a coating of a soluble, hydrated, silicate bound inorganic salt in admixture with an N—H compound, which N—H compound reacts relatively rapidly with the hypohalite ion to produce the corresponding N-halo compound under conditions of elevated hypohalite levels surrounding the encapsulated bleach particles undergoing initial dissolution in aqueous media during preparation of the bleach solution, but which N—H compound reacts relatively slowly with the hypohalite to form said corresponding N-halo compound under the conditions of low hypohalite levels in the final bleach solution after mixing and dissolution of the bleaching agent, the ratio of N-halo compound to N—H compound in said particles being from about 1:1 to about 50:1.

2. A storage stable, chlorine bleach composition having improved fabric compatibility comprising encapsulated particles of a chlorinated isocyanurate bleaching agent, said particles having thereon a coating of a soluble, hydrated, silicate bound inorganic salt containing a soluble halogen accepting N—H compound selected from the group consisting of a sulfamate, an N-alkylcarboxamide and alanine, the ratio of chlorinated isocyanurate to N—H compound being from about 1:1 to about 50:1.

3. The composition according to claim 2 wherein the chlorinated isocyanurate is selected from the class consisting of potassium dichloroisocyanurate and sodium dichloroisocyanurate and hydrated salts thereof.

4. The composition according to claim 2 wherein the N—H compound is a sulfamate.

5. A storage stable, chlorine bleach composition having improved fabric dye compatibility comprising encapsulated particles of a chlorinated isocyanurate bleaching agent, said particles having thereon a coating of a soluble, hydrated, sodium silicate bound inorganic salt containing sulfamic acid, the said particles containing by weight about 1 to 40% chlorinated isocyanurate; about 30 to 90% of inorganic salt; about 2 to 20% of sodium silicate and about 1 to 20% of sulfamic acid.

6. The composition according to claim 5 wherein the chlorinated isocyanurate is sodium dichloroisocyanurate dihydrate.

7. The composition according to claim 6 wherein the chlorinated isocyanurate is potassium dichloroisocyanurate.

8. A detergent composition consisting essentially of by weight (a) from about 5% to about 50% of the bleach composition of any of claims 1 through 7; (b) from about 5% to about 50% by weight of a detergent agent and (c) from about 1% to about 60% by weight of a detergency builder.

9. A process of preparing a storage stable, chlorine bleach composition having improved fabric dye compatibility comprising:

A. forming a granular dry mix consisting essentially of a chlorinated isocyanurate bleaching agent, a soluble, halogen accepting N—H compound selected from the group consisting of a sulfamate, an N-alkylcarboxamide and alanine, and a soluble, hydratable inorganic salt at least 50% by weight of the non-bleach solids having a mean diameter of about 2 to 50 times smaller than said bleaching agent; and B. adding with agitation to said dry mix an aqueous solution of sodium silicate to induce agglomeration and produce particles of chlorinated isocyanurate coated with a layer of silicate bound, at least partially hydrated inorganic salt containing said N—H compound, the $SiO_2/Na_2O$ weight ratio in said silicate solution being from about 3.22:1 to about 2.40:1 and having a total solids content of about 1.0 to 50% by weight.

10. The process according to claim 9 wherein the bleaching agent is sodium dichloroisocyanurate dihydrate.

11. The process according to claim 9 wherein the bleaching agent is potassium dichloroisocyanurate.

12. The process according to claim 9 wherein the N—H compound is sulfamic acid.

13. The process according to claim 9 wherein the hydratable inorganic salt is anhydrous sodium carbonate.

* * * * *